United States Patent [19]

Ball

[11] Patent Number: 4,804,116

[45] Date of Patent: Feb. 14, 1989

[54] VALVE FOR DISPENSING FLUID FROM A CONTAINER

[75] Inventor: Martin F. Ball, Wantage, United Kingdom

[73] Assignee: Metal Box Public Limited Company, United Kingdom

[21] Appl. No.: 91,385

[22] Filed: Aug. 31, 1987

[30] Foreign Application Priority Data

Sep. 11, 1986 [GB] United Kingdom ..... 8621937

[51] Int. Cl.[4] ..... B67D 1/04

[52] U.S. Cl. ..... 222/402.16; 222/399; 222/402.22; 251/354

[58] Field of Search ..... 222/399, 400.7, 402.21, 222/402.22, 402.23, 402.1, 464, 382, 394, 402.13, 402.14, 402.16, 402.17, 402.18, 388; 251/149.8, 349, 354; 137/212; 239/577; 141/2, 3, 18

[56] References Cited

U.S. PATENT DOCUMENTS

| | | | |
|---|---|---|---|
| 824,249 | 6/1906 | Kleinfeldt | 222/399 |
| 1,099,925 | 6/1914 | Kleinfeldt et al. | 222/399 |
| 2,831,618 | 4/1958 | Soffer et al. | 222/402.22 |
| 3,373,907 | 3/1968 | Batrow | 222/400.7 X |
| 3,506,241 | 4/1970 | Ewald | 222/402.2 X |
| 4,220,258 | 9/1980 | Gruenewald | 222/402.2 X |
| 4,310,108 | 1/1982 | Motoyama et al. | 222/399 X |
| 4,450,853 | 5/1984 | Dessenoix et al. | 222/400.7 X |
| 4,615,470 | 10/1986 | Hyland et al. | 222/402.16 |

FOREIGN PATENT DOCUMENTS

| | | | |
|---|---|---|---|
| 217615 | 4/1987 | European Pat. Off. | 222/399 |

*Primary Examiner*—Kevin P. Shaver

*Attorney, Agent, or Firm*—Wood, Dalton, Phillips, Mason & Rowe

[57] ABSTRACT

A valve which comprises a closure member adapted for attachment to the container. The closure member defines an aperture therein. A hollow grommet of flexible material having a flange portion to one side of the closure member and a tubular portion extends through the aperture in the closure member. A valve rod having at one end a flange engaged with the underside of the flange of the grommet and a hollow stem portion extending through the grommet to protrude therefrom such that upon tilting of the valve rod relative to the closure member the flange of the valve rod parts from the underside of the flange of the grommet to uncover a radial hole in the stem portion through which pressurized fluid can pass into the hollow stem portion for dispensing. A gallery or annular passageway is provided in between the grommet and flange of the valve rod and arranged to admit pressurizing gas through the closure member into the container when the valve rod is tilted.

6 Claims, 2 Drawing Sheets

VALVE FOR DISPENSING FLUID FROM A CONTAINER

This invention relates to a valve for dispensing fluid from a container and more particularly but not exclusively to a valve for simultaneously dispensing a carbonated drink from a container and replenishing the headspace pressure therein to maintain carbonation at a desired level.

A valve for dispensing pressurised fluid from a container is known. This known valve comprises a closure member adapted for attachment to the container, said closure member defining an aperture therein; a hollow grommet of flexible material having a flange portion to one side of the closure member and tubular portion extending through the aperture in the closing member; and a valve rod having at one end a flange engaged with the underside of the flange of the grommet and a hollow stem portion extending through the grommet to protrude therefrom so that upon tilting of the valve rod relative to the closure member the flange of the valve rod parts from the underside of the flange of the grommet to uncover a radial hole in the stem portion through which pressurized fluid can pass into the hollow stem portion for dispensing.

One such valve is known as the "CLAYTON VALVE" and is used on aerosol cans to dispense pasty products. However, such valves only dispense the product; they are not adapted to permit repressuring of the can during dispensing. Nor does the CLAYTON VALVE have a dip tube to reach to a desired location in the container so these valves cannot be used to dispense a sparkling wine or carbonated beverage while maintaining a pressure in the container to preserve the quality of the drink.

According to this invention there is provided a valve having a gallery or annular passageway in between the grommet and flange of the valve rod is arranged to admit pressuring gas through the closure member into the container. The annular passageway may either be defined by an annular recess in the material of the closure member or alternatively by a recess in the upper face of the flange of the grommet. In either arrangement a passageway for gas is provided through the closure member so that pressurised gas may be fed to the annular passageway. A suitable pipe union may be provided.

In one embodiment of the valve a skirt portion depends from the periphery of the flange of the grommet to surround the flange of the valve rod and extend to a free end adapted to receive a dip tube.

In a described embodiment the closure member has a skirt portion provided with a female screw thread for engagement with a male thread in a bottle. However any other known method of fixing a closure to a beverage container may be used if desired; for example a crimped on crown or a double seam if the closure be a can end.

A pouring adapter or nozzle may be snap fitted onto the protruding end of the valve rod if desired so that pressure applied to the adapter opens the valve.

In a further aspect this invention provides the valve when fitted to a bottle containing a pressurized fluid and connected to a pressure regulator fitted on a can containing carbon dioxide under pressure so that when in use gas pressure in the bottle is regulated to a desired pressure at all states of emptying of the bottle.

One embodiment of the invention will now be described, by way of example, with reference to the accompanyng diagrammatic drawings, in which:

FIG. 1*a* is a part section side view of a prior art valve;

FIG. 1*b* is a section view of the valve of FIG. 1*a* when open;

Figure 1A:
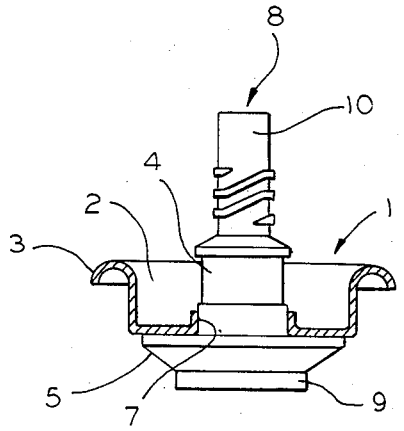
FIG. 1(a) (PRIOR ART)
Figure 1B:
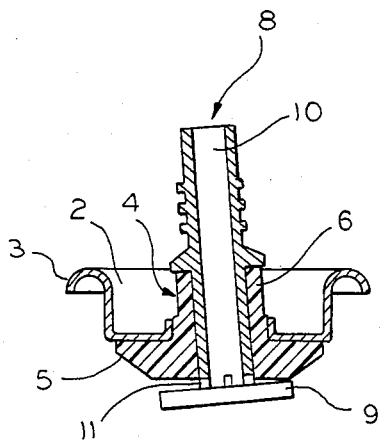
FIG. 1(b) (PRIOR ART)

FIGS. 1*a* and 1*b* show that a prior art valve 1 known as the "CLAYTON VALVE" comprises a metal mounting cup 2, a hollow grommet 4 and a hollow valve rod 8 which is tilted relative to the mounting cup 2 to open the valve. The mounting cup 2 has a peripheral curl 3 shaped to permit attachment to a neck of an aerosol can by swaging the cup into an aperture in the neck (not shown). The hollow grommet of flexible material has a flange 5 in contact with the underside of the cup 2 (as drawn) and an annular portion 6 extending through an aperture 7 in the cup. The hollow valve rod 8 has a flange 9 engaged with the underside of the grommet flange 5 and a hollow stem 10 extending through the grommet 4 to protrude therefrom. The protruding portion is provided with a screw thread to receive a screw cap (not shown).

When the valve rod 8 is tilted relative to the mounting cup 2 the flange 9 of the valve rod parts from the underside of the grommet flange 5 to uncover a radial hole 11 in the stem portion 10 so that a pressurized product in an aerosol can may pass through the radial hole 11 into the hollow stem for dispensing.

This prior art valve is designed to dispense product under vapour pressure from a propellant. In spite of the theoretical constancy of vapor pressure at a fixed ambient temperature there remains a risk that the vapor pressure will abate if there is insufficient propellant and some product may not be dispensed. If a pressurized gas is used instead of a propellant the propelling pressure will inevitably abate as predicted by Charles Law so there remains a need to replenish the headspace pressure in containers dispensing pressurized fluids.

Figure 2:
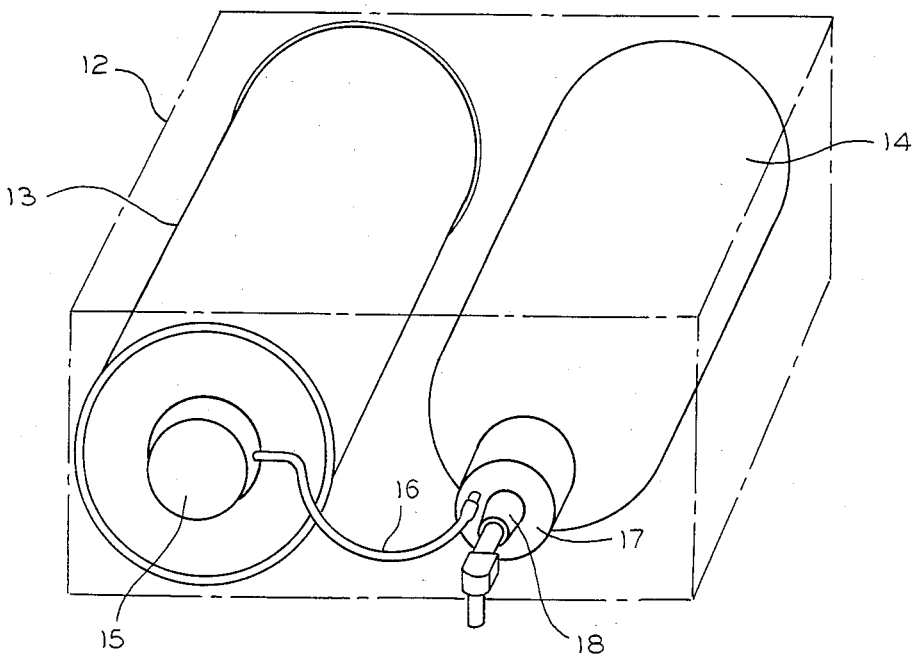
FIG. 2 is a perspective sketch of a beverage dispensing package incorporating a valve according to the invention.

FIG. 2 shows a beverage dispensing package comprising an outer cardboard box 12, an aerosol-type can 13 containing carbon dioxide under pressure (about 1 MPa) and a bottle 14 containing a carbonated drink. A regulator 15 passes carbon dioxide at a controlled pressure through a pipe 16 and closure 17 into the bottle 14 to replenish the pressure in the headspace of the bottle when some of the drink is dispensed through valve 18. The reader is directed to our copending and commonly owned Britsh Patent Application No. 8523575 which has been published as U.K. Patent Application GB No. 2 180 890 A for description of a suitable regulator and the benefits afforded by such a disposable system.

This invention relates to an improved valve, herein denoted 18, which may be fitted to a variety of known bottle or can closures as are used in the drinks trade.

Figure 3:
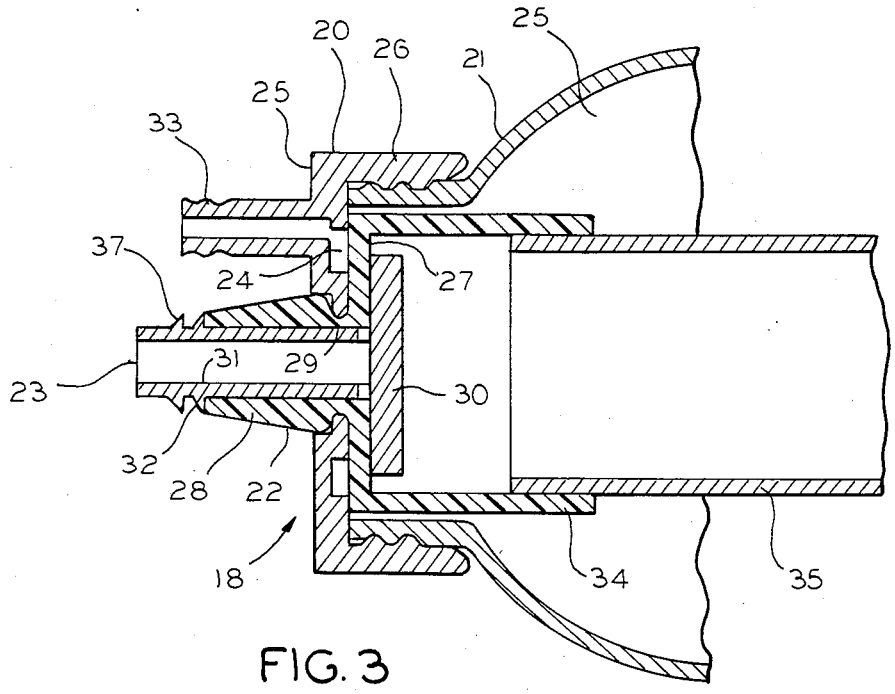
FIG. 3 is a sectioned side view of a valve according to the invention when closed.

In FIG. 3 the valve 18 comprises a closure member in the form of a screw cap 20 molded from a plastics material to fit on a bottle neck 21, a hollow grommet 22 sealingly engaged with an aperture in the screw cap, a hollow valve rod 23 and means to introduce pressurized gas into a annular passageway 24 between the grommet 22 and the interior of the screw cap 20. Tilting of the valve rod 23 relative to the screw cap 20 not only opens an exit path for the contents of the bottle but also opens a path for entry of pressurized gas into the annular passageway 24 and headspace to maintain gas pressure in the bottle.

Referring to FIG. 3 it will be seen that the screw cap 20 comprises a substantially flat closure wall 25 and a peripheral dependent skirt 26 having internal threads to engage with complementary threads on the bottle neck 21 to pull the end wall into sealing engagement with the end of the neck 21. A gasket (not shown) may be provided.

In the center of the closure wall 25 there is an aperture through which extends the hollow grommet 22 which has inside the screw cap 20 a flange portion 27 formed to a tubular portion 28 by a waist portion 29 which sealingly engages with the cap material defining the aperture.

The valve rod 23 has a flange 30 engaged with the interior face of the grommet flange portion 27 and a hollow stem portion 31 extending through the grommet to protrude therefrom and provided externally with two peripheral, axially spaced barbs. The first barb 32 on the hollow stem, co-operates with the flange 30 at the other end of the rod, to prevent slipping of the rod in an axial direction through the grommet.

In the embodiment shown in FIG. 3 the annular passageway 24 is defined by annular recess moulded into the end wall 25. A pipe union 33 provides access for gas into the annular passageway 24. However, in an embodiment (not shown) the annular passageway could alternatively be molded into the face of the flange 27 of the grommet because the purpose of the annular passageway is to distribute gas in between the end wall 25 and flange 27 to a position at which, when the valve rod 23 is tilted in any direction, the gas can pass into the bottle.

In FIG. 3 a tubular skirt portion 34 extends from the periphery of grommet flange 27 to receive one end of a dip tube 35. The other end of the dip tube (not shown) may be weighted so that it seeks the lowest level in the bottle to draw all the fluid contents. If, however, the bottle is dispensed mouth downwards the skirt 34 and dip tube 35 are redundant.

Figure 4:
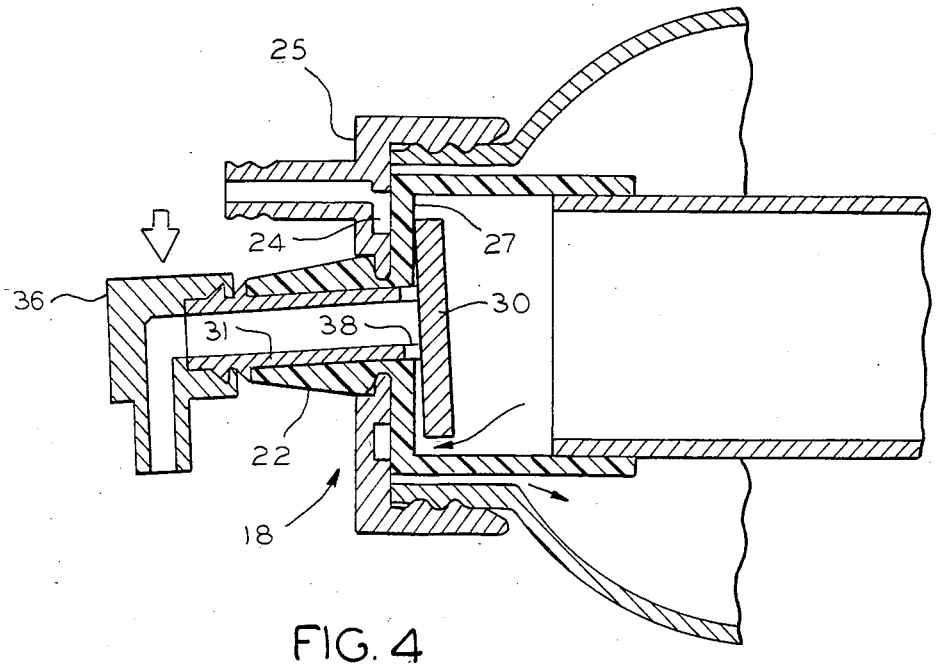
FIG. 4 is a like view of the same valve when open.

FIG. 4 shows the valve 18 in the "open" position during dispensing of fluid and entry of pressurizing gas. A pouring adapter 36 has been snap fitted onto a second barb 37 on the valve rod 23 so that pressure, as arrowed, on the adapter 36 tilts the valve rod 23 relative to the end wall 25 of the screw cap. The flange 30 of the valve rod pivots on the interior face of grommet flange 27 to part from the opposite side (lower side as drawn in FIG. 4) of the grommet flange so that the flange 27 can be distended by gas pressure from annular passageway 24 to permit entry of the gas into the bottle.

The same tilting action which parts the flange 30 of the valve rod from the interior face of grommet flange 27 also uncovers at least one radial hole 38 so that the contents of the bottle may pass between the valve rod flange 30 and grommet flange 27 into the radial hole 38 and hence along the hollow stem portion 31 for dispensing through the pouring adapter 36. When manual pressure is removed from the pouring adaptor 36 the grommet flexes back to the axial position shown in FIG. 3 to close off both the product exit and the gas entry.

Whilst the valve has been discribed with reference to a screw cap molded from a plastics material various alternative closure fixings may be used. For example the grommet could be crimped into a cup like the CLAYTON VALVE cup which could be crimped onto a bottle lip or alternatively a conventional can end to be fixed by a folded double seam to a can, could be modified by addition of a molded gas feed nozzle like the pipe union 33.

Whilst the embodiment described with reference to FIGS. 2, 3 and 4 operates with the bottle lying on its side the valve may, if desired be used upright, by provision of a suitable adapter and dip tube, or as mentioned, bottle neck downwards without a dip tube.

I claim:

1. A valve for dispensing pressurized fluid from a container, said valve comprising a closure member adapted for attachment to the container, said closure member defining an aperture therein, a hollow grommet of flexible material having a flange to the inner side of the closure member and a tubular outlet portion extending through the aperture in the closure member, an annular passageway being defined between an outer side of the flange of the grommet and the adjacent portion of the closure member, the annular passageway communicating with an inlet on said closure member, and a valve rod having at one end a flange engaged with the inner side of the flange of the grommet and a hollow stem portion extending through the grommet to protrude therefrom, the valve being so arranged that, upon tilting of the valve rod relative to the closure member, the flange of the valve rod parts from the inner side of the flange of the grommet to uncover a radial hole in the stem portion, whereby communication is provided between the inner side of the valve and the outlet portion, and whereby contact between the other side of the flange of the grommet and adjacent portion of the closure member is released so that communication may be provided between the inlet and the inner side of the valve.

2. A valve member according to claim 1 wherein the inlet has a hollow pipe union which extends from the annular passageway and is adapted for connection to gas supply means.

3. A valve member according to claim 1 wherein a skirt portion depends from the periphery of the flange of the grommet to surround the flange of the valve rod and the free end of said skirt portion is adapted to receive the end of a dip tube.

4. A valve member according to claim 1 wherein the closure member has a skirt portion provided with a screw thread for engagement with a complementary thread of a bottle which represents said container.

5. A valve according to claim 1 wherein a pouring adapter is snap fitted on the protruding end of the hollow stem portion so that when the adapter is depressed the valve opens.

6. A valve for dispensing pressurized fluid from a container, said valve comprising a closure member adapted for attachment to the container, said closure member defining an aperture therein; a hollow grommet of flexible material having a flange to one side of the closure member and a tubular portion extending through the aperture in the closure member; and a valve rod having at one end a flange engaged with the underside of the flange of the grommet and a hollow stem portion extending through the grommet to protrude therefrom so that upon tilting of the valve rod relative to the closure member the flange of the valve rod parts from the underside of the flange of the grommet to uncover a radial hole in the stem portion through which pressurized fluid can pass from the container into the hollow stem portion for dispensing; wherein an annular passage defined by the topside of the flange of the grommet and inside of the closure member is arranged to admit pressurizing gas through an aperture in the closure member into the container while the hollow stem portion dispenses pressurized fluid from the container.

* * * * *